US007806738B2

(12) United States Patent
Wu et al.

(10) Patent No.: US 7,806,738 B2
(45) Date of Patent: Oct. 5, 2010

(54) POWER SOURCE TERMINAL STRUCTURE

(75) Inventors: Chin-Pao Wu, Taipei (TW); Hai-Wen Yang, Shan Xi (CN)

(73) Assignee: Nextronics Engineering Corp., Taipei County (TW)

( * ) Notice: Subject to any disclaimer, the term of this patent is extended or adjusted under 35 U.S.C. 154(b) by 33 days.

(21) Appl. No.: 12/230,813

(22) Filed: Sep. 5, 2008

(65) Prior Publication Data

US 2009/0209143 A1 Aug. 20, 2009

(30) Foreign Application Priority Data

Feb. 18, 2008 (TW) ..... 97202836 U

(51) Int. Cl.
*H01R 4/48* (2006.01)

(52) U.S. Cl. ..... 439/860

(58) Field of Classification Search ..... 439/860, 439/856, 852, 857, 682, 845, 839, 884, 947
See application file for complete search history.

(56) References Cited

U.S. PATENT DOCUMENTS 3,514,740 A * 5/1970 Filson ..... 439/290
5,158,740 A * 10/1992 Boatwright ..... 376/261
7,604,489 B2 * 10/2009 Shuey et al. ..... 439/79

* cited by examiner

*Primary Examiner*—Alexander Gilman
(74) *Attorney, Agent, or Firm*—Rosenberg, Klein & Lee

(57) ABSTRACT

A power source terminal structure includes an insertion terminal and a docking terminal. The insertion terminal has a main body and a contacting portion. The contacting portion is formed by extending from one end of the main body. The contacting portion is provided with a first protrusion. The docking terminal has a base and two elastic arms. The two elastic arms clamp the main body. The base is provided with a second protrusion opposite perpendicular to the first protrusion. The second protrusion contacts the first protrusion. Via this arrangement, the contact area between the insertion terminal and the docking terminal can be increased, and the reliability of the connector for transmitting the electric current and signals can be increased. Thus, the electric current is more stable.

6 Claims, 5 Drawing Sheets

POWER SOURCE TERMINAL STRUCTURE

BACKGROUND OF THE INVENTION

1. Field of the Invention

The present invention relates to a power source terminal structure, and in particular to a power source terminal structure that can be applied to a Micro Telecommunication Computing Architecture (MicroTCA).

2. Description of Related Art

Micro Telecommunication Computing Architecture (referred to as "MicroTCA" hereinafter) is a standard framework for telecommunication grade COTS (Commercial Off-The-Shelf) chassis, which aims to allow Advanced Mezzanine Cards (AMC) to function without any advanced Telecommunications Computing Architecture (AdvancedTCA) carrier card, and the standard is established by PCI Industrial Computer Manufacturer Group (referred to as "PICMG" hereinafter). The standard of MicroTCA is designated PICMG MTCA.X. A common MicroTCA framework is provided therein with at least one controller (Shelf Management Controller, referred to as "ShMC" hereinafter) to execute a Shelf Management Software (referred to as "ShMS" hereinafter) that acts as a management center of the whole framework. The ShMS is used to internally manage each port, fan, and temperature sensor inside the framework and used to externally communicate with a shelf system management program outside the framework. Each platform in the framework has to be equipped with an Intelligent Platform Management Controller (referred to as "IPMC" hereinafter) for monitoring and recoding the operating states of the platform, reporting and solving abnormal conditions, and controlling the power source and data channels on the platform.

In a broad sense, a connector is a connecting element and accessories thereof that can be used in electronic signals and power sources. The connector is used as a bridge for transmitting signals. Thus, the quality of the connector has an influence on the reliability of transmitting electric currents and signals. Furthermore, the quality of associated electronic mechanics will be affected accordingly.

The connector is used to transmit control signals and power source, thereby activating an electronic device to process the above-mentioned control signals. FIG. 1 shows a conventional power source terminal structure. The power source terminal structure is provided in the form of a power source connector and a docking connector (not shown). The power source terminal structure is formed into a metal sheet and includes an insertion terminal 1*a* and a docking terminal 2*a*. The insertion terminal 1*a* has a main body 11*a* and a first insertion portion 12*a*. The first insertion portion 12*a* is formed by means of extending from one side of the main body 11*a*. The first insertion portion 12*a* can be inserted into an insertion hole 31*a* of a power source circuit board 3*a*. The docking terminal 2*a* has a base 21*a*, a second insertion portion 22*a* and two elastic arms 23*a*, 24*a*. The second insertion portion 22*a* is formed by means of extending from one end of the base 2*a*. The second insertion portion 22*a* can be inserted into an insertion hole 41*a* of a grounding circuit board 4*a*. The two elastic arms 23*a*, 24*a* are formed by extending from the other end of the base 21*a* respectively. The elastic arm 23*a* is straight, while the elastic arm 24*a* is curved. The free ends of the two elastic arms 23*a*, 24*a* are formed with a clamping portion 231*a*, 241*a* respectively. The two clamping portions 231*a*, 241*a* can clamp the main body 11*a* of the insertion terminal 1*a*, thereby achieving the electrical connection between the power source connector and the docking connector.

However, when the power source connector is inserted in the docking connector, improper insertion may often cause a poor contact between the insertion terminal 1*a* and the docking terminal 2*a*. Further, any vibration may result in an unsteady current, and thus affects the reliability of transmitting the electric current and signals.

Consequently, because of the above technical defects, the inventor strives via experience and research to develop the present invention, which can effectively improve the limitations described above.

SUMMARY OF THE INVENTION

The object of the present invention is to provide a power source terminal structure for Micro Telecommunication Computing Architecture (MicroTCA), thereby increasing the reliability of a connector for transmitting electric current and signals and making the electric current more stable.

In order to achieve the above objects, the present invention provides a power source terminal structure, which includes an insertion terminal having a main body, a first insertion portion and a contacting portion. The first insertion portion is located at one side of the main body. The contacting portion is formed by extending from one end of the main body. The contacting portion has a first protrusion. A docking terminal has a base, a second insertion portion and two elastic arms. The second insertion portion is formed by extending from one end of the base. The two elastic arms are formed by extending from the base and away from the second insertion portion. The two elastic arms clamp the main body. The base has a second protrusion opposite to the first protrusion, and the second protrusion contacts the first protrusion.

The present invention has advantageous features as follows. The contacting portion of the insertion terminal is provided with a first protrusion. The base of the docking terminal is provided with a second protrusion opposite to the first protrusion and the second protrusion contacts the first protrusion. Via this arrangement, the contact area between the insertion terminal and the docking terminal can be increased, and the reliability of the connector for transmitting the electric current and signals can be increased. Thus, the electric current is more stable.

In order to further understand the characteristics and technical contents of the present invention, a detailed description relating thereto will be made with reference to the accompanying drawings. However, the drawings are illustrative only, and not used to limit the scope of the present invention.

DETAILED DESCRIPTION OF THE PREFERRED EMBODIMENTS

Figure 1:
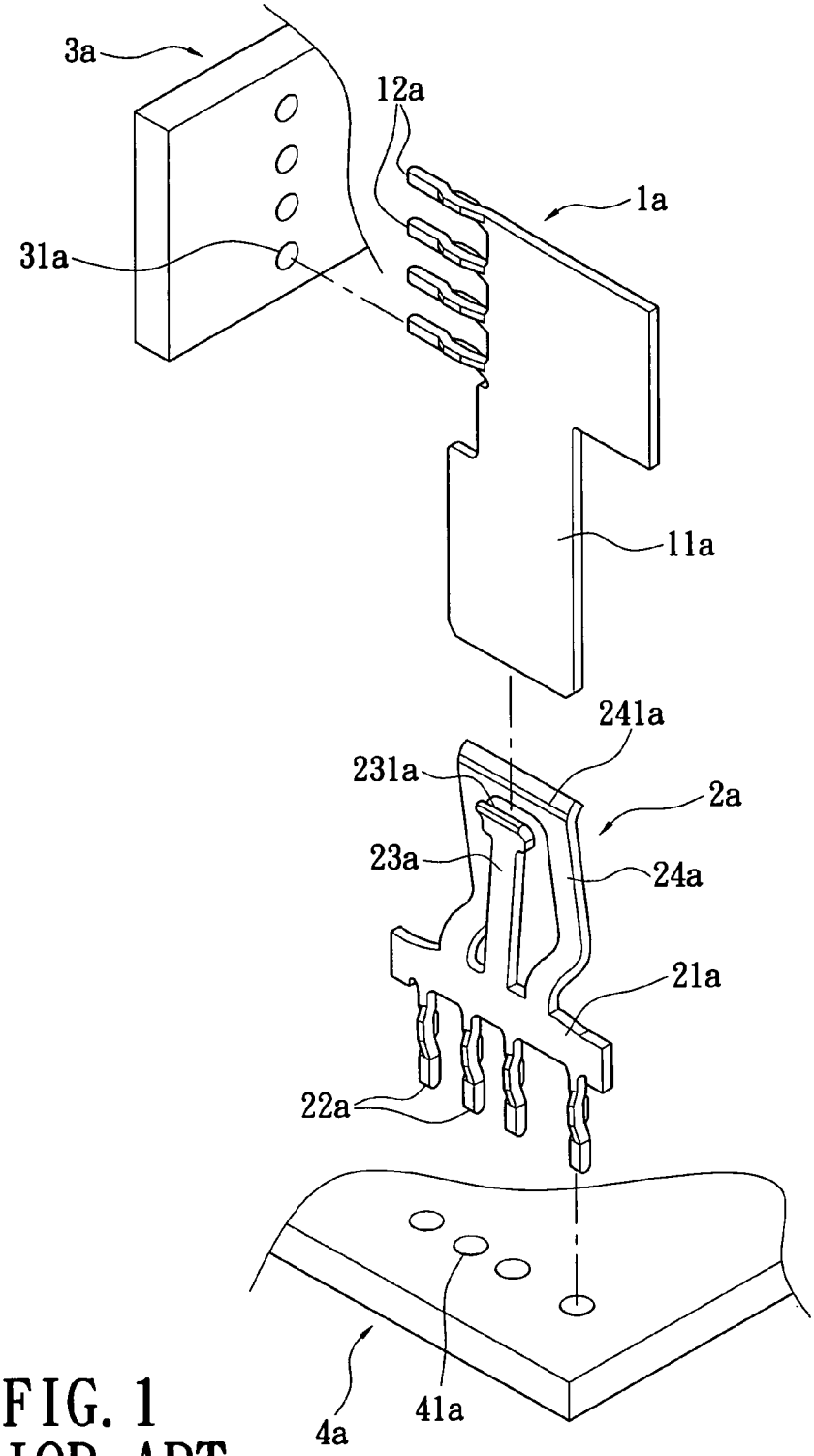
FIG. 1 PRIOR ART
FIG. 1 is an exploded perspective view showing a conventional power source terminal structure.
Figure 2:
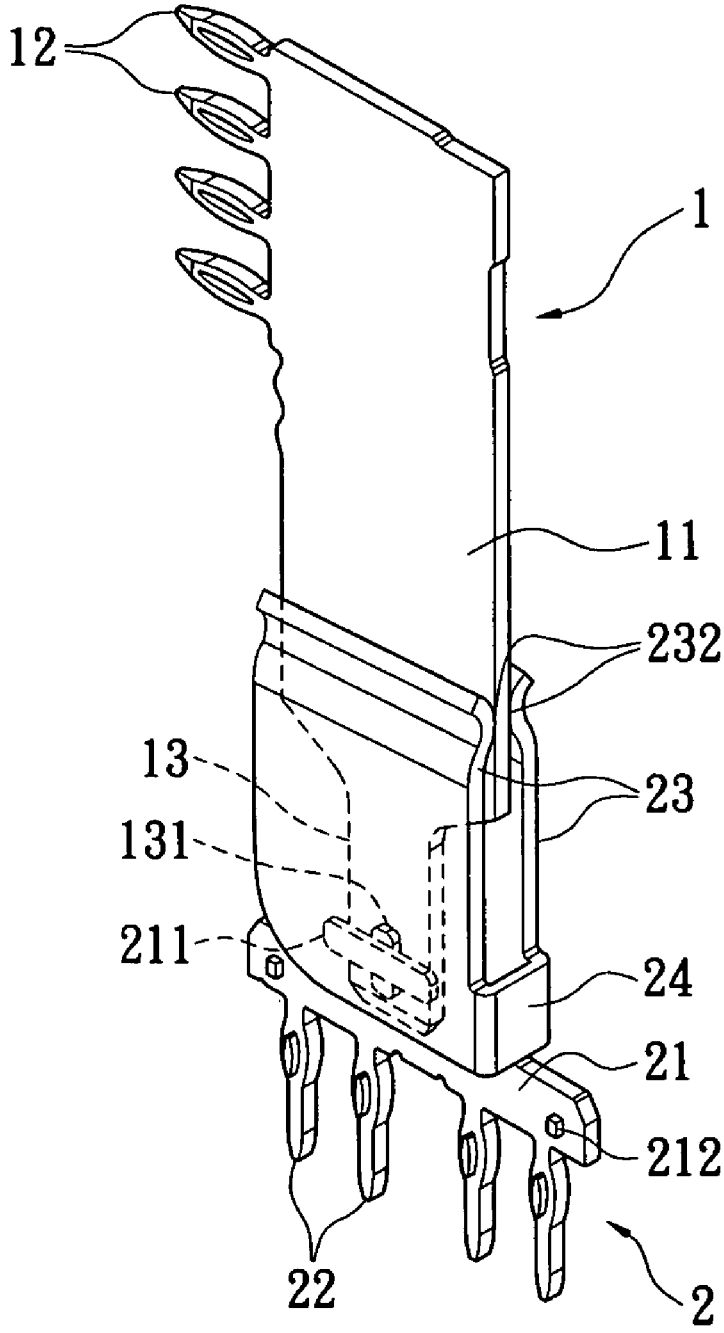
FIG. 2 is a perspective view showing the power source terminal structure of the present invention.
Figure 3:
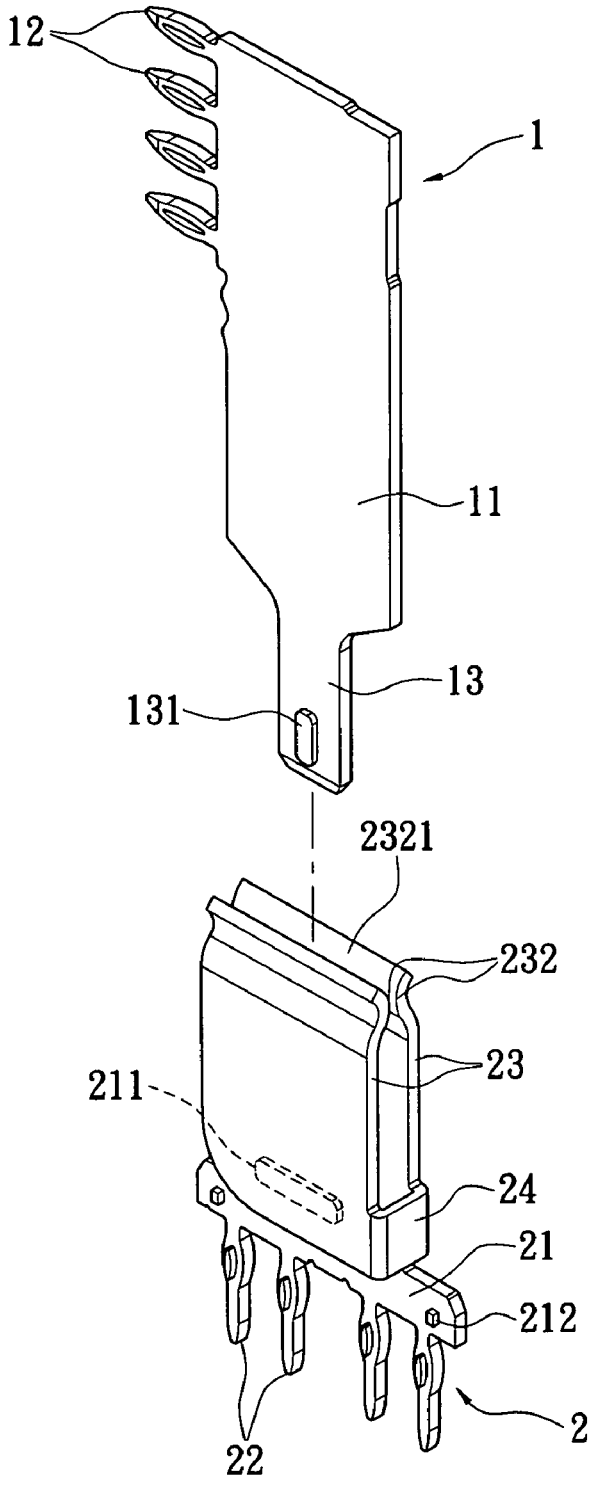
FIG. 3 is an exploded perspective view showing the power source terminal structure of the present invention.
Figure 4:
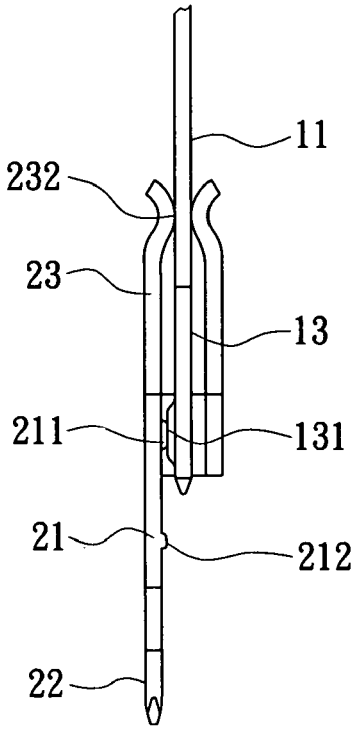
FIG. 4 is a side view showing the power source terminal structure of the present invention.
Figure 5:
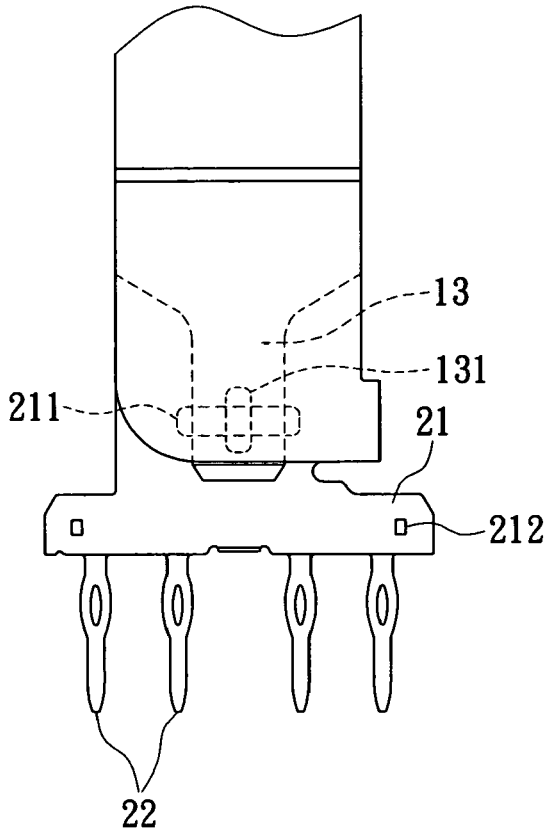
FIG. 5 is a front view showing the power source terminal structure of the present invention.

Please refer to FIGS. 2 to 5. The present invention provides a power source terminal structure. The power source terminal structure is provided in the form of a power source connector and a docking connector (not shown) respectively, and includes an insertion terminal 1 and a docking terminal 2. The insertion terminal 1 is formed into a metal sheet with good electric conductivity, and has a main body 11, a first insertion portion 12 and a contacting portion 13. The main body 11 is formed into an elongate plate. The first insertion portion 12 has a plurality of fish-eye shaped insertion pins that are located on one side of the main body 11. The first insertion portion 12 can be inserted in a power source circuit board (not shown). The contacting portion 13 is formed by extending from one end of the main body 11. In the present embodiment, the contacting portion 13 is provided with a longitudinal first protrusion 131. Of course, a plurality of protrusions can be provided and the number of protrusion does not have to be limited to one.

The docking terminal 2 is also a metal sheet with good electric conductivity. The docking terminal 2 has a base 21, a second insertion portion 22 and two elastic arms 23. The base 21 is provided with a transverse second protrusion 211 opposite to the first protrusion 131. The second protrusion 211 contacts the first protrusion 131. The proximity of both sides of the base 21 is provided with two bosses 212. The two bosses 12 can make the docking terminal 2 to be tightly fitted with the casing of a docking connector, so that the docking terminal 2 can be mounted in the docking connector more firmly.

The second insertion portion 22 is formed by extending from one end of the base 21. The second insertion portion 22 has a plurality of fish-eye shaped insertion pins that are inserted in a grounding circuit board (not shown).

The two elastic arms 23 are formed by extending from the base 21 away from the second insertion portion 22. The two elastic arms 23 are metal pieces having good elasticity. The bottom end of one side of the two elastic arms 23 is connected with a connecting portion 24. The free ends of the two elastic arms 23 are bent to form a clamping portion 232 respectively. An opening 2321 is formed between the two clamping portions 232. The main body 11 extends into the opening 2321, so that the two clamping portions 232 can clamp the main body 11 to achieve an electric connection and fixation.

Figure 6:
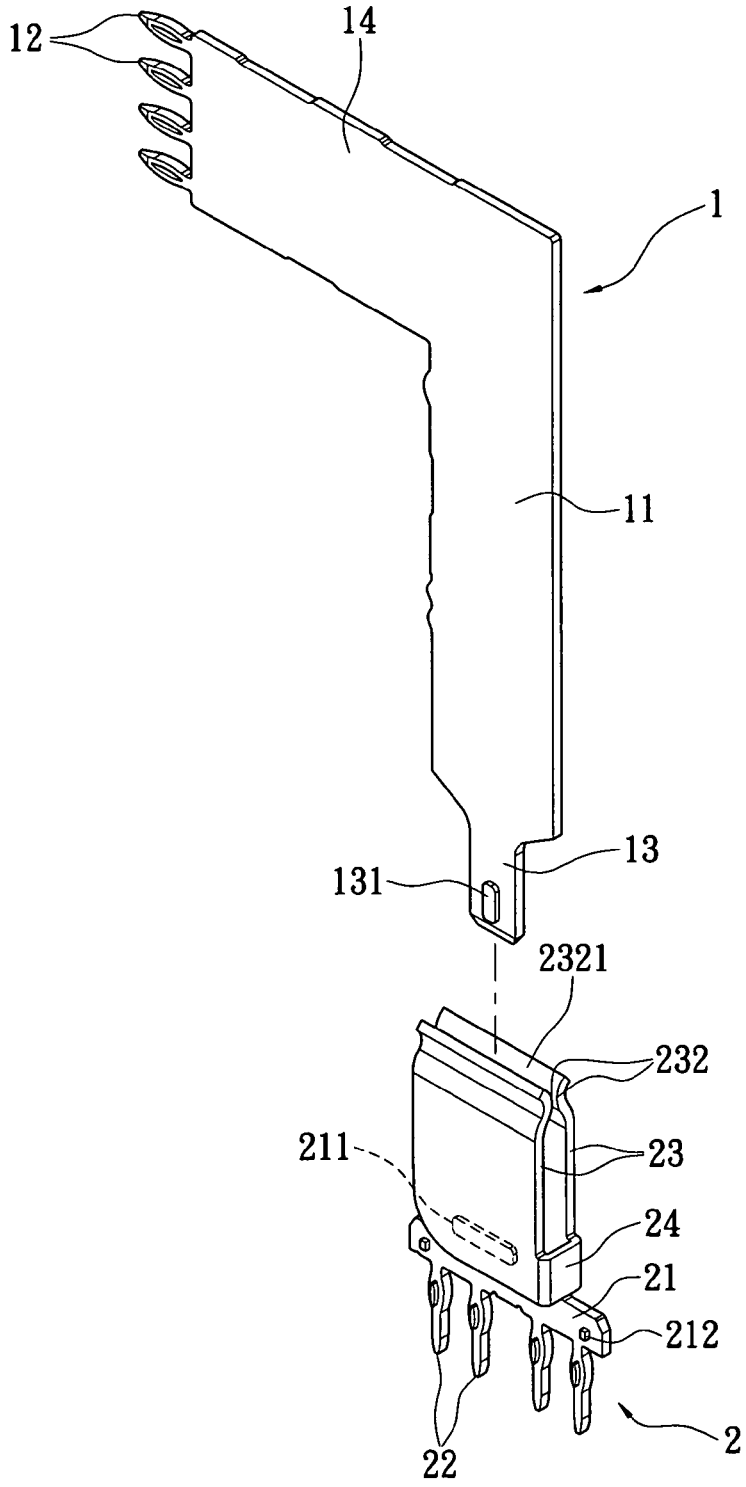
FIG. 6 is an exploded perspective view showing the power source terminal structure in accordance with another embodiment of the present invention.

Please refer to FIG. 6, which is an exploded perspective view showing another embodiment of the present invention. The difference between the present embodiment and the previous embodiment lies in that one side of the main body 11 further extends to form an extending portion 14. The first insertion portion 12 is formed by extending integrally from one side of the extending portion 14.

In the present invention, one end of the insertion terminal 1 extends to form the contacting portion 13. The contacting portion 13 is provided with a first protrusion 131. The base 21 of the docking terminal 2 is provided with the second protrusion 211 opposite to the first protrusion 131 and the second protrusion 211 contacts the first protrusion 131. Via this arrangement, the contact area between the insertion terminal 1 and the docking terminal 2 can be increased, and the reliability of the connector for transmitting the electric current and signals can be increased. Thus, the electric current is more stable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power source terminal structure for Micro Telecommunication Computing Architecture (MicroTCA), comprising:

an insertion terminal having a main body, a first insertion portion and a contacting portion, the first insertion portion being located at one side of the main body, the contacting portion being formed by extending from one end of the main body, the contacting portion being provided with a first protrusion; and a docking terminal having a base, a second insertion portion and two elastic arms forming a U-shaped clamp, the second insertion portion extending from one end of the base, the two elastic arms being formed with one end thereof adjacent one end of the base opposite the second insertion portion, the main body being clamped between the U-shaped clamp, each of the elastic arms having a substantially planar section mounted on opposing surfaces of the main body, one of the two elastic arms having a second protrusion extending from an inner side thereof;

wherein the first and second protrusions are in frictional engagement when the main body is inserted into the U-shaped clamp.

2. The power source terminal structure according to claim 1, wherein one side of the main body further extends to form an extending portion, the first insertion portion is formed by extending integrally from one side of the extending portion.

3. The power source terminal structure according to claim 1, wherein each of the first and second insertion portions has a plurality of insertion pins.

4. The power source terminal structure according to claim 1, wherein the proximity of both sides of the base is provided with two bosses.

5. The power source terminal structure according to claim 1, wherein the bottom end of one side of the two elastic arms is connected with a connecting portion, the free ends of the two elastic arms are bent to form a clamping portion respectively, and the main body being clamped between the two clamping portions.

6. The power source terminal structure according to claim 5, wherein an opening is formed between the two clamping portions and the main body extends into the opening.

* * * * *